US008044646B2

(12) United States Patent
Ozalevli et al.

(10) Patent No.: US 8,044,646 B2
(45) Date of Patent: Oct. 25, 2011

(54) VOLTAGE REGULATOR WITH QUASI FLOATING GATE PASS ELEMENT

(75) Inventors: Erhan Ozalevli, Dallas, TX (US); Luthuli E. Dake, Mckinney, TX (US); Gregory Romas, Mckinney, TX (US); Ching-yuh Tsay, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 421 days.

(21) Appl. No.: 12/422,218

(22) Filed: Apr. 10, 2009

(65) Prior Publication Data

US 2010/0259235 A1 Oct. 14, 2010

(51) Int. Cl.
*G05F 1/565* (2006.01)

(52) U.S. Cl. ..... 323/274; 323/275

(58) Field of Classification Search ..... 323/273, 323/274, 275, 280
See application file for complete search history.

(56) References Cited

U.S. PATENT DOCUMENTS

| | | | | |
|---|---|---|---|---|
| 6,188,212 | B1 | 2/2001 | Larson et al. | |
| 7,893,672 | B2 * | 2/2011 | Scoones et al. | 323/280 |
| 2006/0012354 | A1 * | 1/2006 | Nunokawa et al. | 323/273 |
| 2007/0236190 | A1 * | 10/2007 | Kruiskamp et al. | 323/280 |
| 2010/0259235 | A1 * | 10/2010 | Ozalevli et al. | 323/274 |
| 2011/0156670 | A1 * | 6/2011 | Tadeparthy et al. | 323/273 |

OTHER PUBLICATIONS

Urquidi, Ramirez-Angulo, Gonzalez-Carvajal and Torralba, "A new family of low-voltage circuits based on quasifloating gate transistors," in 2002 IEEE Midwest Symp. on Circuits and Systems, Tulsa, OK, Aug. 4-7, 2002, pp. I-93-96.

Ramirez-Angulo, Lopez-Martin, Carvajal, and Chavero, "Very Low-Voltage Analog Signal Processing Based on Quasi-Floating Gate Transistors", IEEE Journal of Solid-State Circuits, vol. 39, No. 3, Mar. 2004.

Hasler and Lande, "Overview of Floating-Gate Devices, Circuits, and Systems", IEEE Transactions on Circuits and Systems-II: Analog and Digital Signal Processing, vol. 48, No. 1, Jan. 2001.

Shibata and Ohmi, "A Functional MOS Transistor Featuring Gate-Level Weighted Sum and Threshold Operations", IEEE Transactions on Electron Devices, vol. 39, No. 6, Jun. 1992.

* cited by examiner

*Primary Examiner* — Jeffrey Sterrett
(74) *Attorney, Agent, or Firm* — William B. Kempler; Wade J. Brady, III; Frederick J. Telecky

(57) ABSTRACT

Various apparatuses, methods and systems for a voltage regulator are disclosed herein. For example, some embodiments provide an apparatus for regulating a voltage including an N-channel transistor that is connected between an input and an output, an error amplifier that is connected to the output, a capacitor that is connected between the error amplifier and a gate of the N-channel transistor, and a comparator that is connected to a node between the error amplifier and the capacitor. The apparatus also includes a charge pump that is switchably connected to the gate of the N-channel transistor. The apparatus is adapted to connect the charge pump to the gate of the N-channel transistor when a voltage at the node between the error amplifier and the capacitor rises above a threshold voltage.

18 Claims, 4 Drawing Sheets

VOLTAGE REGULATOR WITH QUASI FLOATING GATE PASS ELEMENT

BACKGROUND

A low dropout or LDO voltage regulator is an electronic circuit that is designed to provide a stable output voltage regardless of input voltage variations and load impedance. An LDO voltage regulator is able to maintain output regulation even for a relatively small difference between the input voltage and the output voltage. When regulating the voltage from a battery, an LDO voltage regulator can maintain a steady output voltage for input voltages ranging from high battery voltages down to voltage levels just above the output voltage.

In a linear LDO voltage regulator, a transistor pass element connected between the input and the output is operated in its linear region when the input battery voltage is close to the targeted output voltage. The resistance and thus the voltage drop across the pass element are varied to maintain the desired output voltage. The dropout voltage determines the lowest usable input voltage and is related to the on resistance of the pass element.

The pass element is generally controlled by an error amplifier based on feedback from the output voltage. The error amplifier lowers the resistance of the pass element if the output voltage drops and raises the resistance of the pass element if the output voltage rises. Both p-channel metal oxide semiconductor (PMOS) and n-channel metal oxide semiconductor (NMOS) transistors may be used as pass elements in an LDO voltage regulator. An NMOS transistor has relatively high conductivity, and the error amplifier in an LDO voltage regulator can drive the gate of an NMOS pass element with a voltage just above the output voltage. Because NMOS transistors are much smaller than PMOS transistors, they may be advantageous as a pass element in an LDO voltage regulator. In order to generate enough gate-to-source voltage for the NMOS pass element when the input voltage gets close to the output voltage, the error amplifier is typically powered by a charge pump. However, a charge pump running at high frequencies consumes considerable power to achieve a low amount of ripple on the output voltage. In addition, the charge pump and associated oscillator generates undesirable electromagnetic interference (EMI). Thus, although the small relative size of an NMOS transistor pass element may reduce the size of an LDO voltage regulator, running a charge pump constantly in the LDO voltage regulator is not without disadvantages.

SUMMARY

Various apparatuses, methods and systems for a voltage regulator are disclosed herein. For example, some embodiments provide an apparatus for regulating a voltage including an N-channel transistor that is connected between an input and an output, an error amplifier that is connected to the output, a capacitor that is connected between the error amplifier and a gate of the N-channel transistor, and a comparator that is connected to a node between the error amplifier and the capacitor. The apparatus also includes a charge pump that is switchably connected to the gate of the N-channel transistor. The apparatus is adapted to connect the charge pump to the gate of the N-channel transistor when a voltage at the node between the error amplifier and the capacitor rises above a threshold voltage.

In an embodiment of the apparatus, the error amplifier is powered by a voltage source other than the charge pump.

An embodiment of the apparatus also includes a current source that is connected between the charge pump and the gate of the N-channel transistor.

An embodiment of the apparatus also includes a switch that is connected in series with the current source between the charge pump and the gate of the N-channel transistor, wherein the switch is controlled by the comparator.

An embodiment of the apparatus is adapted to turn on the charge pump when the voltage at the node between the error amplifier and the capacitor rises above the threshold voltage.

In an embodiment of the apparatus, the comparator is a hysteretic comparator.

An embodiment of the apparatus also includes a voltage divider that is connected to the output, and the error amplifier is connected to the output through the voltage divider.

An embodiment of the apparatus also includes a second comparator that is connected to the output through the voltage divider, and a switch that is connected between the gate of the N-channel transistor and a ground. The second comparator is adapted to turn on the switch when a voltage at the output rises above a second threshold voltage.

An embodiment of the apparatus also includes a current source that is connected in series with the switch between the gate of the N-channel transistor and the ground.

In an embodiment of the apparatus, the second comparator is a hysteretic comparator.

An embodiment of the apparatus is adapted to switch between a floating gate mode of operation when the charge pump is disconnected from the gate of the N-channel transistor and a quasi floating gate mode of operation when the charge pump is connected to the gate of the N-channel transistor.

An embodiment of the apparatus is adapted to have a leakage current that drains a voltage at the gate of the N-channel transistor.

An embodiment of the apparatus comprises a low dropout linear voltage regulator.

Other embodiments provide a method for regulating a voltage, including passing a current through an N-channel transistor that is connected between an input and an output of a low dropout voltage regulator, generating an error signal based on a voltage of the output, capacitively coupling the error signal to a gate of the N-channel transistor, and periodically charging the gate of the N-channel transistor with a charge pump based on the error signal.

An embodiment of the method also includes comparing the error signal with a reference voltage. The gate of the N-channel transistor is charged with the charge pump based on the comparison.

In an embodiment of the method, the charge pump is turned on based on the comparison.

An embodiment of the method also includes controlling a current from the charge pump to the gate of the N-channel transistor.

An embodiment of the method also includes comparing the voltage of the output with a reference voltage and discharging the gate of the N-channel transistor based on the comparison.

An embodiment of the method also includes switching between a floating gate mode of operation in the low dropout voltage regulator and a quasi floating gate mode of operation. The floating gate mode of operation comprises the gate of the N-channel transistor being disconnected from the charge pump and the quasi floating gate mode of operation comprises the gate of the N-channel transistor being charged by the charge pump.

This summary provides only a general outline of some particular embodiments. Many other objects, features, advantages and embodiments will become more fully apparent from the following detailed description, the appended claims and the accompanying drawings.

BRIEF DESCRIPTION OF THE DRAWINGS

A further understanding of the various embodiments may be realized by reference to the figures which are described in remaining portions of the specification. In the figures, like reference numerals may be used throughout several drawings to refer to similar components.

DESCRIPTION

The drawings and description, in general, disclose a voltage regulator with a quasi floating gate. Various embodiments are directed at a low dropout linear voltage regulator, although the voltage regulator with a quasi floating gate is not limited to this application. A quasi floating gate N-channel transistor or NMOS transistor is employed as a pass element in the voltage regulator. The gate of the NMOS transistor is capacitively coupled to the error amplifier in the feedback loop, and the gate is periodically charged by a charge pump to increase the gate to source voltage of the NMOS transistor while tracking corrections from the error amplifier. The gate of the NMOS transistor alternates between a quasi floating gate mode during which it is charged by a charge pump and a floating gate mode during which it is disconnected from the charge pump. Because the gate of the NMOS transistor is only periodically charged or refreshed by the charge pump, the power consumption in the voltage regulator is significantly reduced. Electromagnetic interference (EMI) generated by the voltage regulator is also reduced by turning off the charge pump when it is not charging the gate of the NMOS transistor.

Figure 1:
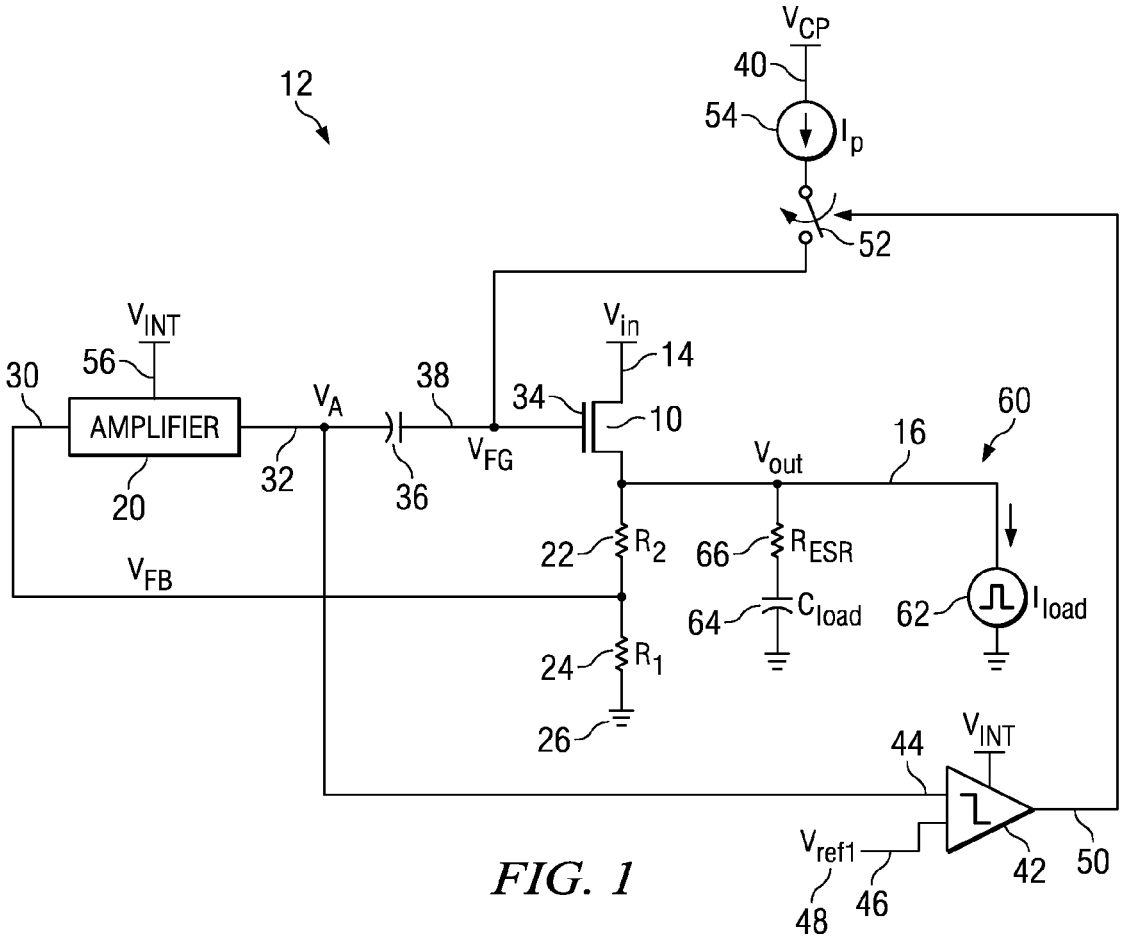
FIG. 1 depicts a low dropout linear voltage regulator with a quasi floating gate and a switchable charge pump charging circuit in accordance with some embodiments.

Turning now to FIG. 1, the NMOS pass transistor 10 in an LDO linear voltage regulator 12 is connected between an input 14 and an output 16. The voltage $V_{OUT}$ at the output 16 is regulated by an error amplifier 20 based on feedback from the output 16. The error amplifier 20 may be connected to the output 16 through a voltage divider made up of resistors 22 and 24 connected in series between the output 16 and ground 26. The feedback voltage $V_{FB}$ at the input 30 to the error amplifier 20 is a fraction of the voltage $V_{OUT}$ at the output 16 of the voltage regulator 12 based on the value of the voltage divider resistors 22 and 24. The voltage $V_A$ at the output 32 of the error amplifier 20 is the result of amplification of the error on the voltage at the output 16, and moves in the opposite direction to the output voltage change to maintain $V_{OUT}$ at a constant voltage. For example, the error amplifier 20 may include an inverting amplifier that amplifies the difference between a reference voltage and the feedback voltage $V_{FB}$ at the input 30 to the error amplifier 20. When the voltage $V_{OUT}$ at the output 16 of the voltage regulator 12 drops below the desired output voltage, the voltage $V_A$ at the output 32 of the error amplifier 20 increases. When the voltage $V_{OUT}$ at the output 16 rises above the desired output voltage, the voltage $V_A$ at the output 32 of the error amplifier 20 decreases. The voltage $V_A$ at the output 32 of the error amplifier 20 may be represented by the equation $V_A=(V_{REF}-V_{FB})*A$, where A is the open loop gain of the error amplifier 20, $V_{REF}$ is the reference voltage set in the error amplifier 20 and $V_{FB}=V_{OUT}*(R2/R1+R2)$.

The output 32 of the error amplifier 20 is capacitively coupled to the gate 34 of the NMOS transistor 10 through a capacitor 36. The gate 34 of the NMOS transistor 10 is therefore floating with respect to the DC bias on the output 32 of the error amplifier 20, although the voltage $V_{FG}$ 38 on the gate 34 tracks changes in the voltage at the output 32 of the error amplifier 20. The charge on the gate 34 of the NMOS transistor 10 is increased periodically by a charge pump (not shown) connected to a charging input 40. Because many charge pump implementations are known, and because the voltage regulator 12 is not limited to use with any particular type of charge pump, the design of the charge pump will not be described in detail.

The charging of the gate 34 of the NMOS transistor 10 is controlled by a hysteretic comparator 42 having one input 44 connected to the output 32 of the error amplifier 20 and another input 46 connected to a reference voltage $V_{REF1}$ 48. When the voltage at the output 32 of the error amplifier 20 exceeds the reference voltage $V_{REF1}$ 48 the output 50 of the comparator 42 is asserted. Because the comparator 42 is hysteretic, the output 50 of the comparator 42 will remain asserted until the voltage at the output 32 of the error amplifier 20 falls a small amount below the reference voltage $V_{REF1}$ 48. This stabilizes the switching of the comparator 42 and prevents oscillation when the voltage at the output 32 of the error amplifier 20 is close to the reference voltage $V_{REF1}$ 48.

The charge pump is connected to the gate 34 of the NMOS transistor 10 through a switch 52 that is controlled by the comparator 42. When the output 50 of the comparator 42 is asserted, the switch 52 is turned on or closed, connecting the charge pump to the gate 34 of the NMOS transistor 10 and raising the voltage $V_{FG}$ 38 of the quasi floating gate. A current source 54 is connected in series with the switch 52 between the charge pump input 40 and the gate 34 of the NMOS transistor 10 to regulate the rate of charging. The rate of charging may be adapted as desired based on factors such as the required frequency response of the NMOS transistor 10, the required power consumption limits of the NMOS transistor 10, etc. The current source 54 may comprise any suitable device for either limiting the current from the charge pump or setting a constant current level when the switch 52 is closed. The switch 52 also ensures that when the charge pump is disabled there is only charge loss from the $V_{FG}$ node 38 but not charge leakage to the $V_{FG}$ node 38 so that amount of charge at $V_{FG}$ 38 can be well controlled.

The stored charge at $V_{FG}$ 38, which is modulated by the charge pump and associated circuits, thus level shifts the voltage $V_A$ at the output 32 of the error amplifier 20 from a level that may be below the voltage $V_{IN}$ at the input 14 and the voltage $V_{OUT}$ at the output 16 to a voltage $V_{FG}$ 38 at the gate 34 of the NMOS transistor 10 higher than the voltage $V_{OUT}$ at the output 16. The floating gate voltage $V_{FG}$ 38 can be expressed as $V_{FG}=V_A*((C/C_{TOTAL})+(Q/C_{TOTAL}))$, where C is the capacitance of the coupling capacitor 36 between the error amplifier 20 and the NMOS transistor 10, $C_{TOTAL}$ is the sum of the capacitances at the gate 34 of the NMOS transistor 10 and includes the capacitance C of the capacitor 36 and the gate capacitance of the NMOS transistor 10, and Q is the charge on the gate 34. The voltage $V_A$ at the output 32 of the error amplifier 20 is influenced toward mid-rail, or half the voltage of internal power rail $V_{INT}$ 56, by setting the reference voltage $V_{REF1}$ 48 at about the mid-rail voltage. When the voltage $V_{OUT}$ at the output 16 drops below the regulation voltage and the voltage $V_A$ at the output 32 of the error amplifier 20 rises past mid-rail, the comparator 42 turns on the charge pump and injects charge to the gate 34 of the NMOS transistor 10. This increases the voltage $V_{OUT}$ at the output 16 and as a result the voltage $V_A$ at the output 32 of the error amplifier 20 falls back to a voltage less than mid-rail. The error amplifier 20 is thus prepared to quickly respond to a falling output voltage $V_{OUT}$ because it is not railed at the internal power rail $V_{INT}$ 56.

In some embodiments of the NMOS transistor 10, the charge pump is also turned on when the output 50 of the comparator 42 is asserted and turned off output 50 of the comparator 42 is not asserted, thereby reducing power consumption and EMI. Although there may be a small delay in starting the charge pump, operation of the NMOS transistor 10 is not inhibited because the feedback loop connecting the charge pump to the gate 34 of the NMOS transistor 10 is relatively slow acting compared to the feedback loop through the error amplifier 20. The charging of the gate 34 of the NMOS transistor 10 by the charge pump acts over time to increase the charge stored at the NMOS transistor 10, and to influence the voltage $V_A$ at the output 32 of the error amplifier 20 toward a mid-rail voltage so that it can respond rapidly to errors in the output voltage $V_{OUT}$. The voltage regulator 12 responds to fast transients using the feedback loop through the error amplifier 20 to maintain the desired output voltage $V_{OUT}$, and the feedback loop through the comparator 42 acts over time to keep the voltage $V_A$ at the output 32 of the error amplifier 20 at about mid-rail to the power supply 56 to the error amplifier 20.

The quasi floating gate 34 of the NMOS transistor 10 and the periodic charging by a charge pump allows the error amplifier 20 to be powered by a lower voltage than the charge pump, such as an internal power rail $V_{INT}$ 56, while maintaining a suitably high $V_{GS}$ on the NMOS transistor 10 even in dropout. The specific voltage levels of the charge pump, input voltage $V_{IN}$ at the input 14, output voltage $V_{OUT}$ at the output 16, and internal power rail $V_{INT}$ 56, etc, may be set at any suitable levels based on the requirements of the voltage regulator 12 and the characteristics of the components (e.g., the NMOS transistor 10) selected for the voltage regulator 12. In one particular example, the output voltage $V_{OUT}$ at the output 16 is regulated to about 5V with an input voltage $V_{IN}$ at the input 14 ranging from about 10V down to just above 5V. In this example, the internal power rail $V_{INT}$ 56 may be about 5V, with the voltage $V_A$ at the output 32 of the error amplifier 20 varying around about 2.5V, and with the charge pump charging the gate 34 of the NMOS transistor 10 to around 6V or even higher during dropout with a current on the order of 100 nA through the current source 54 to conserve power.

The NMOS transistor 10 is designed to have a leakage current that drains the voltage on the gate 34 of the NMOS transistor 10 gradually so that the main control of the charge on the gate 34 is performed by the comparator 42, switch 52, current source 54 and charge pump. This may be accomplished by ensuring that the substrate on which the circuitry of the NMOS transistor 10 is formed is at a lower potential than the gate 34 of the NMOS transistor 10 during operation. This may be accomplished by ensuring that the switches are NMOS based so that the p-n junctions on the gate 34 of the NMOS transistor 10 leak to a lower potential than the voltage at the gate 34 of the NMOS transistor 10. If the voltage regulator 12 is not provided with a draining leakage path at the gate 34 of the NMOS transistor 10, a two way control system that charges and discharges the gate 34 may be used.

The voltage regulator 12 is not limited to use with any particular load 60, and is adapted to maintain a substantially constant output voltage $V_{OUT}$ independent of the load current $I_{LOAD}$ 62 and load impedance, which is represented in FIG. 1 by a load capacitor $C_{LOAD}$ 64 and equivalent series resistor $R_{ESR}$ 66.

Figure 2:
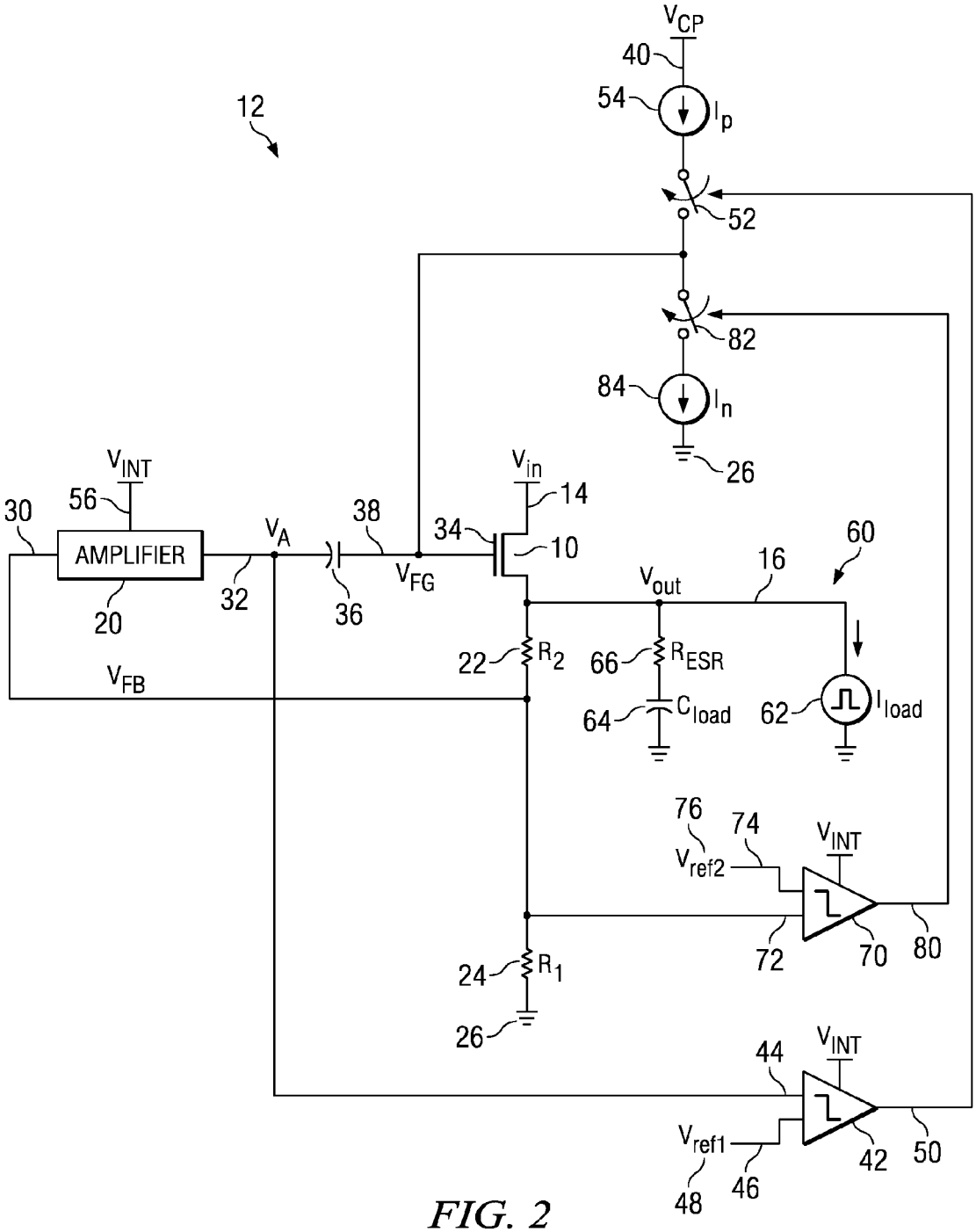
FIG. 2 depicts a low dropout linear voltage regulator with a quasi floating gate and a switchable current sink in accordance with some embodiments.

Turning now to FIG. 2, the voltage regulator 12 may also include a current sink control loop connected to the gate 34 of the NMOS transistor 10 to discharge the gate 34 if the voltage $V_{OUT}$ at the output 16 rises suddenly. For example, this may occur when the voltage $V_{IN}$ at the input 14 drops close to the voltage $V_{OUT}$ at the output 16, raising the voltage $V_{FG}$ 38 at the gate 34 of the NMOS transistor 10, followed by a sudden increase in the voltage $V_{IN}$ at the input 14. The voltage $V_{OUT}$ at the output 16 will rapidly rise in response if the voltage $V_{FG}$ 38 is not lowered. A hysteretic comparator 70 is connected at one input 72 to the output 16 through the voltage divider 22 and 24 and at another input 74 to a reference voltage $V_{REF2}$ 76. When the voltage $V_{OUT}$ at the output 16 as measured through the voltage divider 22 and 24 exceeds the reference voltage $V_{REF2}$ 76 the output 80 of the comparator 70 is asserted. The output 80 of the hysteretic comparator 70 turns on a switch 82, draining the gate 34 of the NMOS transistor 10 to ground 26 through a current source 84. Once the voltage $V_{OUT}$ at the output 16 as measured through the voltage divider 22 and 24 falls a bit below the reference voltage $V_{REF2}$ 76 the output 80 of the comparator 70 is turned off, opening the switch 82. (A voltage may be described herein as "falling below a reference voltage" or "falling below a threshold voltage" when a fractional portion of the voltage as measured by a voltage divider falls below a particular voltage level. The same usage applies herein to a voltage rising above a reference or threshold voltage.)

The voltage regulator 12 may be embodied in any of a number of possible manners, such as in an integrated circuit or using discrete components on a printed circuit board, or as a combination of the two, etc.

Figure 3:
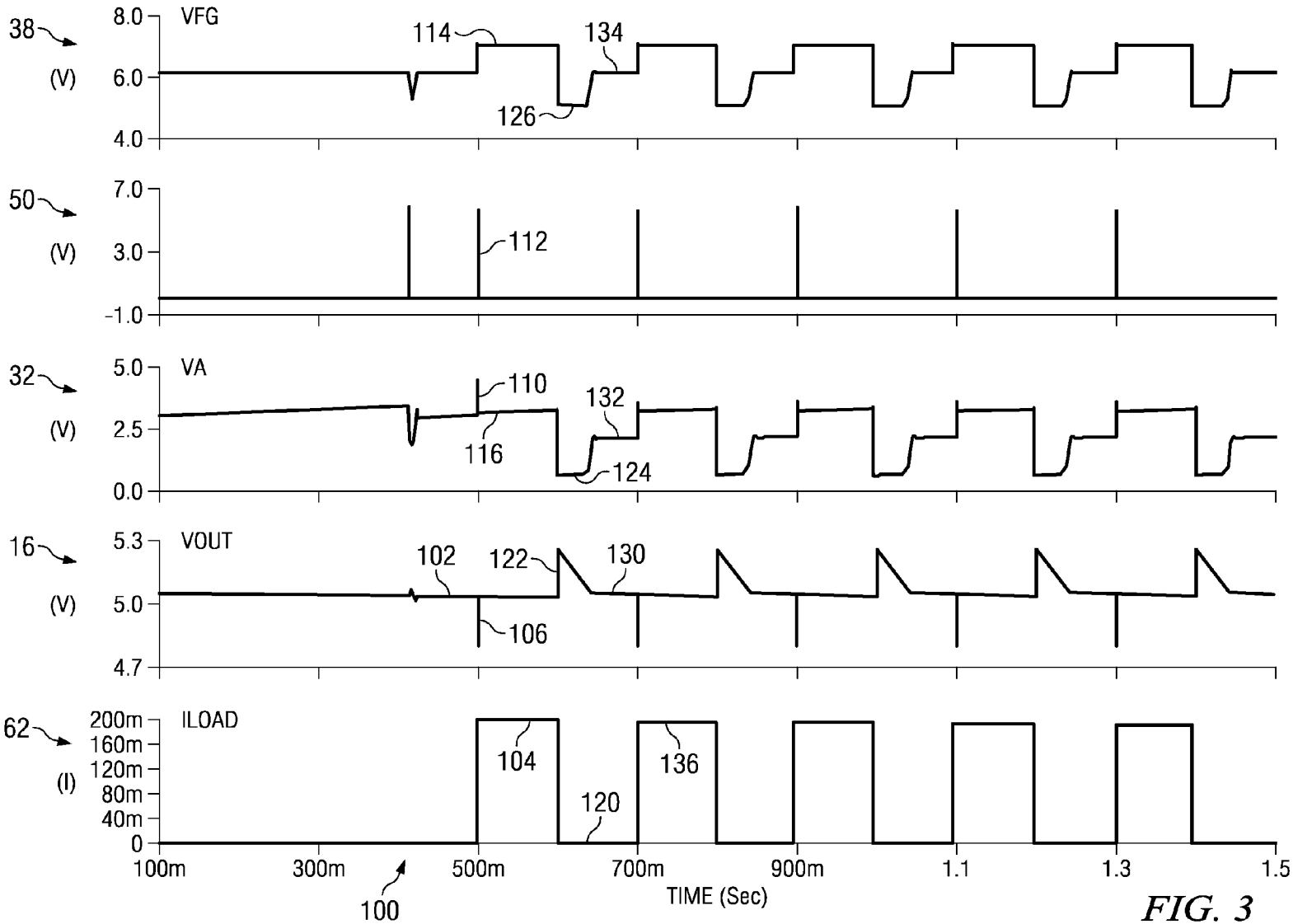
FIG. 3 depicts a plot of a transient response to a load current variation in the voltage regulator of FIG. 2 in accordance with some embodiments.

Turning now to FIG. 3, the transient response of the NMOS transistor 10 to a variation in the load current $I_{LOAD}$ 62 is shown, with the load current $I_{LOAD}$ 62 alternating between 50 μA and 200 mA. The load current $I_{LOAD}$ 62 is off during an initial startup period 100, with the voltage $V_{OUT}$ at the output 16 stabilizing at about 5V 102. When the load current $I_{LOAD}$ 62 increases to 200 mA 104, the voltage $V_{OUT}$ at the output 16 experiences a momentary drop 106. The voltage $V_A$ at the output 32 of the error amplifier 20 has a corresponding spike 110 above the mid-rail level of 2.5V. The output 50 of the comparator 42 is briefly turned on 112, connecting the charging input 40 to the gate 34 of the NMOS transistor 10. The floating gate voltage $V_{FG}$ 38 is thus charged to a higher level 114, allowing the voltage $V_A$ to drop back to about the mid-rail level 116.

When the load current $I_{LOAD}$ 62 drops back to 50 μA 120, the voltage $V_{OUT}$ at the output 16 jumps 122 and the voltage $V_A$ at the output 32 of the error amplifier 20 drops to about a lower rail voltage 124. The floating gate voltage $V_{FG}$ 38 tracks the voltage $V_A$ and drops to about 5V 126. When the voltage $V_{OUT}$ at the output 16 has dropped back to a regulation voltage of 5V 130, the voltage $V_A$ returns to about the mid-rail level of 2.5V 132. The floating gate voltage $V_{FG}$ 38 again tracks the voltage $V_A$ and rises to a steady state level of about 6V 134. When the load current $I_{LOAD}$ 62 increases again to 200 mA 136, cycle repeats. Thus, it may be seen that the voltage $V_A$ at the output 32 of the error amplifier 20 varies around about a mid-rail voltage and the floating gate voltage $V_{FG}$ 38 is level shifted (relative to $V_A$) to a higher voltage using the stored charge provided by the charge pump while continuing to track changes in the voltage $V_A$.

Figure 4:
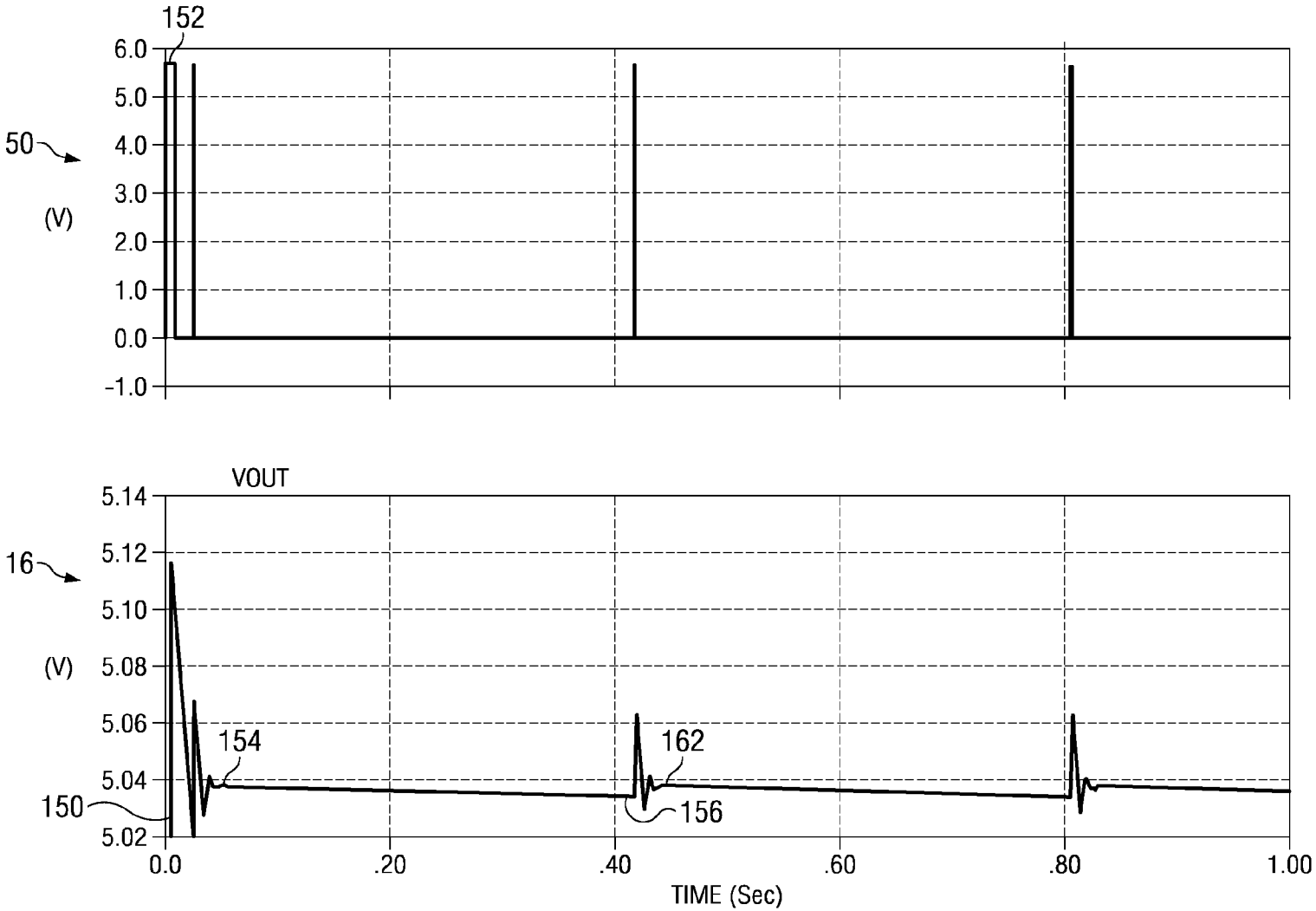
FIG. 4 depicts a plot of a transient response to a source current $I_P$ in the voltage regulator of FIG. 2 in accordance with some embodiments.

Turning now to FIG. 4, the transient response of the NMOS transistor 10 to the current $I_P$ through the current source 54 is shown. When the voltage regulator 12 is first powered on, the voltage $V_{OUT}$ at the output 16 rises from a low level 150. The voltage $V_A$ at the output 32 of the error amplifier 20 will be high, asserting the output 50 of the comparator 42 and turning on and momentarily enabling the charge pump. Once the voltage $V_{OUT}$ at the output 16 is stabilized at the regulation voltage 154, it will gradually fall due to the leakage current draining the floating gate voltage $V_{FG}$ 38. When the voltage $V_{OUT}$ at the output 16 has fallen to the point 156 where the voltage $V_A$ at the output 32 of the error amplifier 20 rises above a threshold voltage, the charge pump is again turned on momentarily. When the voltage $V_{OUT}$ at the output 16 rises 162 enough that the voltage $V_A$ at the output 32 of the error amplifier 20 falls and turns off the hysteretic comparator 42, the charge pump is turned off and disconnected and the cycle repeats.

Figure 5:
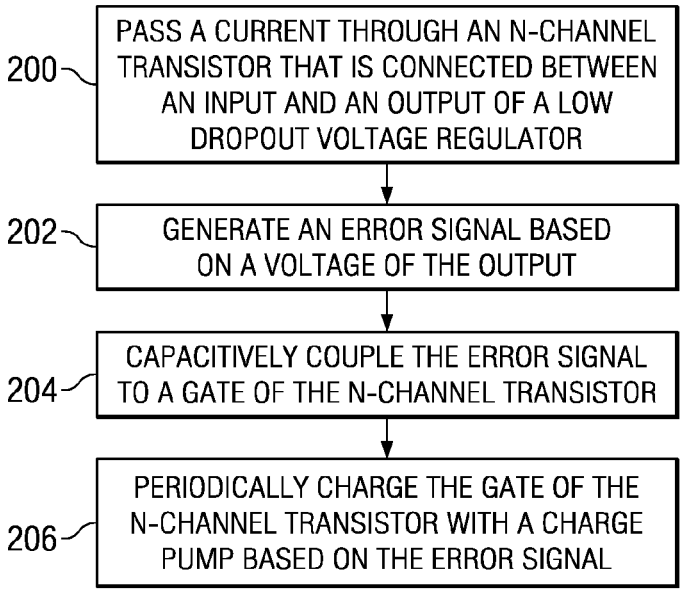
FIG. 5 is a flow chart of a method for regulating a voltage in accordance with some embodiments.

A method for regulating a voltage in accordance with some embodiments is illustrated in FIG. 5. The method includes passing a current through an N-channel transistor that is connected between an input and an output of a low dropout voltage regulator (block 200), generating an error signal based on a voltage of the output (block 202), capacitively coupling the error signal to a gate of the N-channel transistor (block 204), and periodically charging the gate of the N-channel transistor with a charge pump based on the error signal (block 206).

The voltage regulator with a quasi floating gate as disclosed herein provides significant benefits, including the reduced size by the use of an NMOS pass element, and reduced power consumption and EMI by periodic operation of a charge pump. The error amplifier and other comparators in the voltage regulator may be powered by an internal voltage rail that is lower than the input voltage rather than by a charge pump. The output of the error amplifier is level shifted by the periodic charge from the charge pump, keeping the output of the error amplifier about mid-rail to the internal voltage rail while maintaining a high gate to source voltage for the NMOS pass element. The voltage regulator alternates between a floating gate mode of operation during which there is no DC path to the gate of the pass element and a quasi floating gate mode of operation during which there is a DC path from the gate of the pass element to the charge pump.

While illustrative embodiments have been described in detail herein, it is to be understood that the concepts disclosed herein may be otherwise variously embodied and employed.

What is claimed is:

1. An apparatus for regulating a voltage, the apparatus comprising:

an N-channel transistor that is connected between an input and an output;

an error amplifier that is connected to the output;

a capacitor that is connected between the error amplifier and a gate of the N-channel transistor;

a comparator that is connected to a node between the error amplifier and the capacitor;

a charge pump; and a switch that is connected between the charge pump and the gate of the N-channel transistor, wherein the switch is controlled by the comparator, and wherein the apparatus is adapted to connect the charge pump to the gate of the N-channel transistor when a voltage at the node between the error amplifier and the capacitor rises above a threshold voltage.

2. The apparatus of claim 1, wherein the error amplifier is powered by a voltage source other than the charge pump.

3. The apparatus of claim 1, further comprising a current source that is connected between the charge pump and the gate of the N-channel transistor.

4. The apparatus of claim 1, wherein the apparatus is adapted to turn on the charge pump when the voltage at the node between the error amplifier and the capacitor rises above the threshold voltage.

5. The apparatus of claim 1, wherein the comparator comprises a hysteretic comparator.

6. The apparatus of claim 1, further comprising a voltage divider that is connected to the output, wherein the error amplifier is connected to the output through the voltage divider.

7. The apparatus of claim 6, further comprising:

a second comparator that is connected to the output through the voltage divider; and a switch that is connected between the gate of the N-channel transistor and a ground, wherein the second comparator is adapted to turn on the switch when a voltage at the output rises above a second threshold voltage.

8. The apparatus of claim 7, further comprising a current source that is connected in series with the switch between the gate of the N-channel transistor and the ground.

9. The apparatus of claim 7, wherein the second comparator comprises a hysteretic comparator.

10. The apparatus of claim 1, wherein the apparatus is adapted to switch between a floating gate mode of operation when the charge pump is disconnected from the gate of the N-channel transistor and a quasi floating gate mode of operation when the charge pump is connected to the gate of the N-channel transistor.

11. The apparatus of claim 1, wherein the apparatus is adapted to have a leakage current that drains a voltage at the gate of the N-channel transistor.

12. The apparatus of claim 1, wherein the apparatus comprises a low dropout linear voltage regulator.

13. A method for regulating a voltage, the method comprising:

passing a current through an N-channel transistor that is connected between an input and an output of a low dropout voltage regulator;

generating an error signal based on a voltage of the output;

capacitively coupling the error signal to a gate of the N-channel transistor;

comparing the error signal with a reference voltage; and periodically actuating the switch to charge the gate of the N-channel transistor with a charge pump based at least in part on the comparison of the error signal and the reference voltage.

14. The method of claim 13, wherein the charge pump is turned on based on the comparison.

15. The method of claim 13, further comprising controlling a current from the charge pump to the gate of the N-channel transistor.

16. The method of claim 13, further comprising comparing the voltage of the output with a reference voltage and discharging the gate of the N-channel transistor based on the comparison.

17. The method of claim 13, further comprising switching between a floating gate mode of operation in the low dropout voltage regulator and a quasi floating gate mode of operation, wherein the floating gate mode of operation comprises the gate of the N-channel transistor being disconnected from the charge pump and the quasi floating gate mode of operation comprises the gate of the N-channel transistor being charged by the charge pump.

18. A low dropout linear voltage regulator comprising:

an N-channel transistor that is connected between an input and an output of the low dropout linear voltage regulator;

an error amplifier that is connected to the output through a voltage divider;

a capacitor that is connected between the error amplifier and a gate of the N-channel transistor;

a hysteretic comparator that is connected to a node between the error amplifier and the capacitor;

a charge pump that is connected to the gate of the N-channel transistor through a switch and a current source, wherein the switch and the current source are connected in series between the charge pump and the gate of the N-channel transistor, and wherein the switch is controlled by the hysteretic comparator;

a second hysteretic comparator connected to the output through the voltage divider;

a second switch connected between the gate of the N-channel transistor and a ground, wherein the second switch is controlled by the second hysteretic comparator;

a second current source connected in series with the second switch between the gate of the N-channel transistor and the ground;

wherein the low dropout linear voltage regulator is adapted to turn on the charge pump and to connect the charge pump to the gate of the N-channel transistor when a voltage at the node between the error amplifier and the capacitor rises above a threshold voltage, and wherein the error amplifier is powered by a voltage source other than the charge pump;

wherein the low dropout linear voltage regulator is adapted to switch between a floating gate mode of operation when the charge pump is disconnected from the gate of the N-channel transistor and a quasi floating gate mode of operation when the charge pump is connected to the gate of the N-channel transistor; and wherein the low dropout linear voltage regulator is adapted to have a leakage current that drains a voltage at the gate of the N-channel transistor.

* * * * *